US005161939A

United States Patent [19]

Stadler

[11] Patent Number: 5,161,939

[45] Date of Patent: Nov. 10, 1992

[54] AIR COMPRESSION SYSTEM

[75] Inventor: David M. Stadler, Birmingham, Mich.

[73] Assignee: Turbo Concepts, Inc., Farmington Hills, Mich.

[21] Appl. No.: 729,048

[22] Filed: Jul. 12, 1991

[51] Int. Cl.[5] ..... F01D 1/24

[52] U.S. Cl. ..... 415/60; 415/177; 415/180; 415/224.5; 415/204; 415/206

[58] Field of Search ..... 415/203, 204, 206, 60, 415/61, 177, 178, 180, 224.5, 225, 226; 417/362

[56] References Cited

U.S. PATENT DOCUMENTS

| | | | |
|---|---|---|---|
| 1,183,075 | 5/1916 | Kiefer | 415/226 |
| 2,046,226 | 6/1936 | Weightman et al. | 415/226 |
| 2,601,030 | 6/1952 | Klein et al. | 415/180 |
| 2,812,718 | 11/1957 | Stolte | 415/225 |
| 3,779,667 | 12/1973 | Johnson | 415/226 |
| 4,780,056 | 10/1988 | Toth | 417/362 |
| 4,925,368 | 5/1990 | Toth | 417/362 |
| 5,030,061 | 7/1991 | Meissgeier | 415/203 |

FOREIGN PATENT DOCUMENTS

| | | | |
|---|---|---|---|
| 2940279 | 4/1981 | Fed. Rep. of Germany | 417/362 |
| 0068506 | 6/1979 | Japan | 415/180 |
| 69184 | 12/1951 | Netherlands | 415/204 |

*Primary Examiner*—Thomas E. Denion
*Attorney, Agent, or Firm*—Lyon & Delevie

[57] ABSTRACT

The disclosure relates to a fully integrated single stage centrifugal air compression system that exhibits a relatively high flow rate at relatively low pressure. The air compression system comprises a single impeller that is driven through a belt drive by a conventional electric motor. A novel parallel wall axially split diffuser converts the high kinetic energy of air leaving the impeller into pressure energy. Cooling of the air compressor is achieved by an integral fan on the motor pulley which draws filtered ambient air into a plenum. Plenum air is ducted through a novel system of heat exchangers which draw heat from the compressor bearings. A passage through the center of the compressor drive shaft conducts pressurized air from the plenum through the drive shaft to cool the bearings, resulting in a bearing running temperature slightly above ambient.

11 Claims, 8 Drawing Sheets

252
254
60
64
28
250
26
66
240
52
9
62
32
71
228
144
84
80
82
86
140
11
11
127
142
130
34
120
104
72
140
50
52
100
110
5
102
30
20
36
23
40
42

FIG. 6.
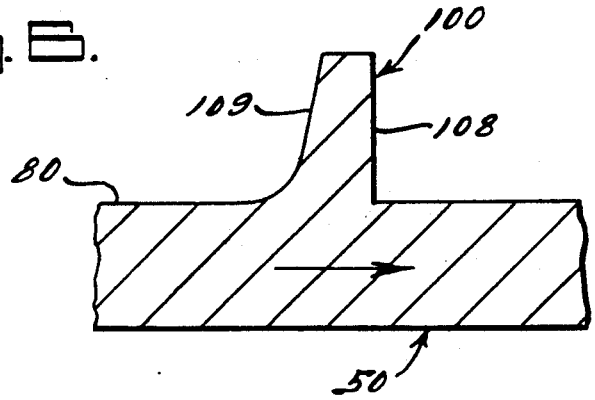
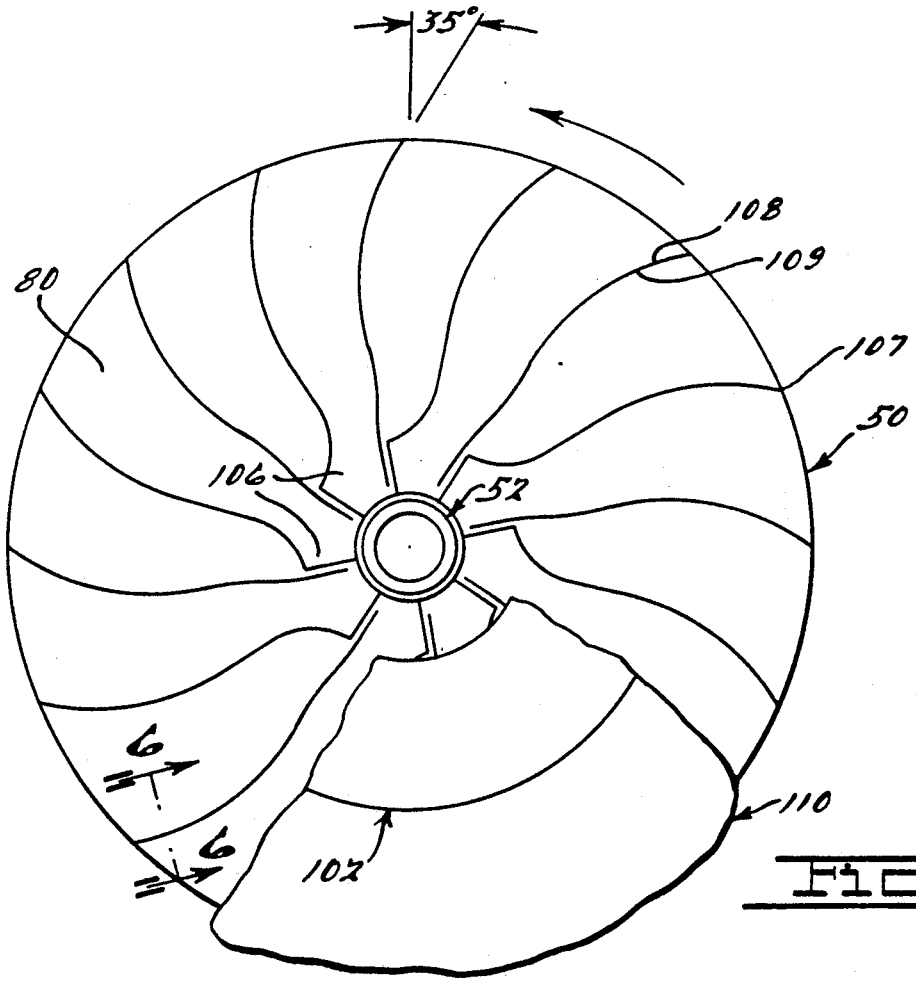
FIG. 5.

FIG. 7.
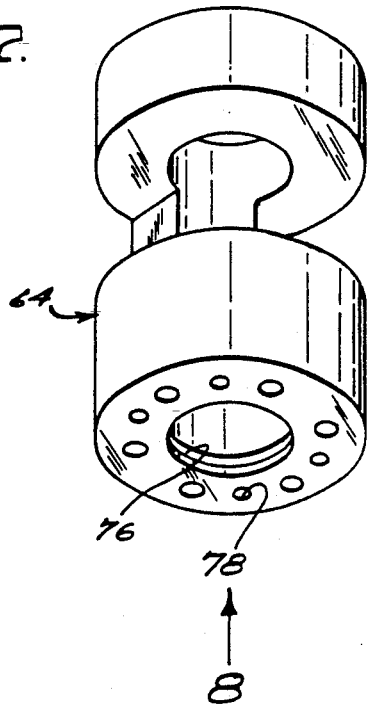
FIG. 8.
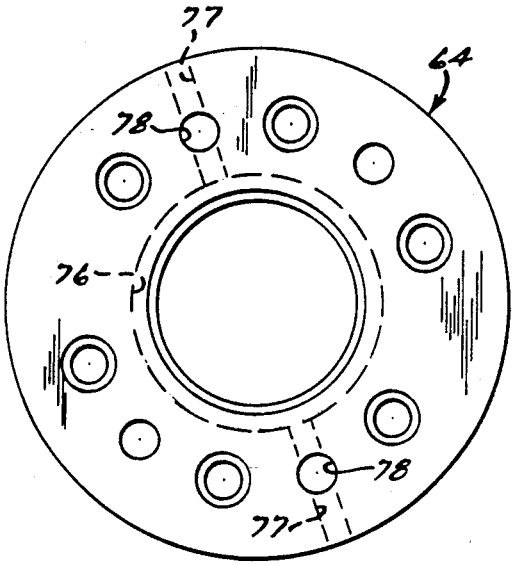
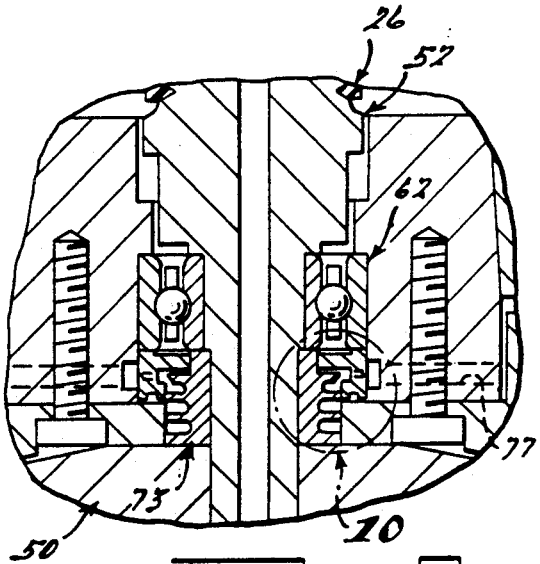
FIG. 9.
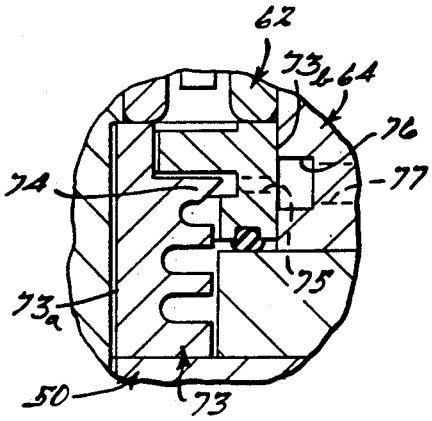
FIG. 10.

AIR COMPRESSION SYSTEM

BACKGROUND OF THE INVENTION

The present invention relates generally to air compressors and more particularly to a fully integrated single stage centrifugal air compression system that exhibits a relatively high flow rate at relatively low pressure and maximizes efficiency and life expectancy. Such air compressors have particular utility for use in industrial spray painting systems, hi speed drying, and hydrotherapy systems. Known compressors are relatively ineffecient, exhibit undesirable noise characteristics, and are subject to premature mechanical failure.

SUMMARY OF THE INVENTION

The invention comprises an improvement in the art of fluid dynamics. A high speed centrifugal compressor comprises a single impeller that is driven through a belt drive by a conventional electric motor. Motor speed is 3,600 RPM and compressor speed is approximately 30,000 RPM after step up achieved by the ratio between the motor and compressor belt drive pulleys. The compressor generates relatively high volumes of air for example, 300 CFM, at relatively low pressure, for example, from 7-10 p.s.i. The compressor exhibits high efficiency, quiet operation and minimal maintenance. The motor and compressor are mounted on the underside of a plenum, facilitating top access to the plenum and providing a relatively low center of gravity to maximize stability.

While centrifugal impellers of the type utilized maximize efficiency as the tip speed thereof approaches the speed of sound, impeller tip speed must be kept subsonic so that the impeller's critical surge line does not result in destructive or audible pressure waves. The impeller of the present invention solves the aforesaid problem by transcending into a slurry mode when output is throttled which is evidenced by shuttling of pressure within the air chambers defined by the blades of the impeller. This feature is complemented by the use of a unique parallel wall diffuser that converts the high kinetic energy of air leaving the impeller into pressure energy.

The working face of the impeller is of concave conical radial cross section having a plurality of radially and axially extending blades orientated in a circumferentially spaced array on the concave working face thereof. The blades are folded circumferentially rearwardly, relative to the direction of rotation. From a point tangent to the terminus of the concave radius of the working face to the outside diameter of the impeller, the blades are swept backward 35° and are parallel with the surface of the impeller housing and parallel wall diffuser. The impeller is disposed in an impeller housing having a central opening of convex conical cross section complementary to the impeller.

Air is inducted axially through the center of the impeller housing to the impeller and is accelerated radially along the radially extending portion of the impeller blades. The air then moves across a flat radial plane on the impeller where it encounters the backwardly curved terminal end portions of the blades. The air is then accelerated further until it exits at the periphery of the impeller with relatively high kinetic energy. This energy is transformed into pressure energy in a parallel wall diffuser which opens into a unique annular air discharge scroll disposed radially outwardly of the impeller. As the air expands, it moves into the scroll thence circumferentially until exiting tangentially directly adjacent to a splitter portion of the scroll.

The compressor can be operated at air flows slightly above surge due to throttled discharge conditions without overheating. All of the compressor's capacity, subject to ampere rating of the motor, can be made available by utilizing a conventional diaphragm balanced relief valve. This feature allows use of "non bleeder" atomizing spray guns or air on demand applications such as blow-off nozzles. The compressor is energy efficient since only a small amount of air is moved by the compressor when the relief valve is open to a position just above the surge line of the compressor.

Cooling of an air compressor is critical to sustained performance. Accordingly, the electric motor utilizes a drive pulley having an integral fan which draws filtered ambient air into a plenum through a suction tube. Inducted air moves axially through the pulley and is pressurized thereby to, for example, 1 p.s.i. Plenum air is ducted at relatively high velocity through a novel system of heat exchangers which draw heat from the compressor bearings. Cooling air is pressurized to a second stage by an integral fan and belt tension pulley to maximize flow through the heat exchangers. Cooling efficiency is enhanced by a compressor base plate having concentric grooves which duct cooling air first circumferentially then tangentially outwardly through the sides of the plenum.

Another significant feature of the bearing cooling system is a passage through the center of the compressor drive shaft for conducting pressurized air from the plenum through the drive shaft to cool the bearings. This air flow pattern provides air flow adjacent to the inner race of the bearings thereby continually removing heat from the bearings.

The aforesaid air flow system results in a running temperature of the ball bearing adjacent to the compressor impeller that is maintained at 30°-35° F. above ambient temperature. The bearing at the opposite end of the compressor shaft is maintained at 26°-30° F. above ambient. For example, on a 70° F. day, temperature of the bearings at 30,000 RPM is slightly above body temperature which is a significant contribution to bearing life.

The drive system also contributes to cooling of the assembly since the motor mounted drive pulley and blades attached to the underside thereof act as a heat sink for heat generated by the drive belt and motor. The belt runs in a pressurized plenum that is only 10° above ambient and is constantly cooled by air flow through the drive pulley and plenum.

Another feature is that the drive belt is tensioned at all times by an automatic belt tension adjuster which features pneumatic damping. The belt tension adjuster maintains proper tension and belt wrap on the compressor pulley while attenuating inertial shock at startup as the rotating mass accelerates from 0 to full RPM in approximately 3 seconds. A belt tensioner spring also serves as a shock damper which in combination with complementary pistons in chambers, effect damping of pulsations preventing the tensioner spring from going into resonance.

Yet another feature of the invention is that the sound level is kept well below a level that is damaging to hearing. High frequency sound is suppressed by the use of anechoic foam within the air filter of the compressor.

Another feature of the invention is that the pressurized output air is filtered and has no oil with which to contend. Moreover, no water droplets are evidenced. Thus, the air can be used directly for atomizing paint or in drying operations.

Operator safety is a prime consideration in the compressor of the present invention. The compressor and related drive components are housed in a sealed chamber comprising a 5/16" thick metal dome. Should the compressor impeller disintegrate it will be contained within said metal dome as well as the massive aluminum plenum surrounding it.

BRIEF DESCRIPTION OF THE DRAWINGS

FIG. 5 is a view taken in the direction of the arrow 5 of FIG. 4;

FIG. 6 is a view taken along the line 6—6 of FIG. 5;

FIG. 7 is a perspective view of the bearing housing;

FIG. 8 is a view taken in the direction of the arrow 8 of FIG. 7;

FIG. 9 is a view taken within the circle 9 of FIG. 4;

FIG. 10 is a view taken within the circle of FIG. 9;

DETAILED DESCRIPTION OF THE PREFERRED EMBODIMENT OF THE INVENTION

Figure 1:
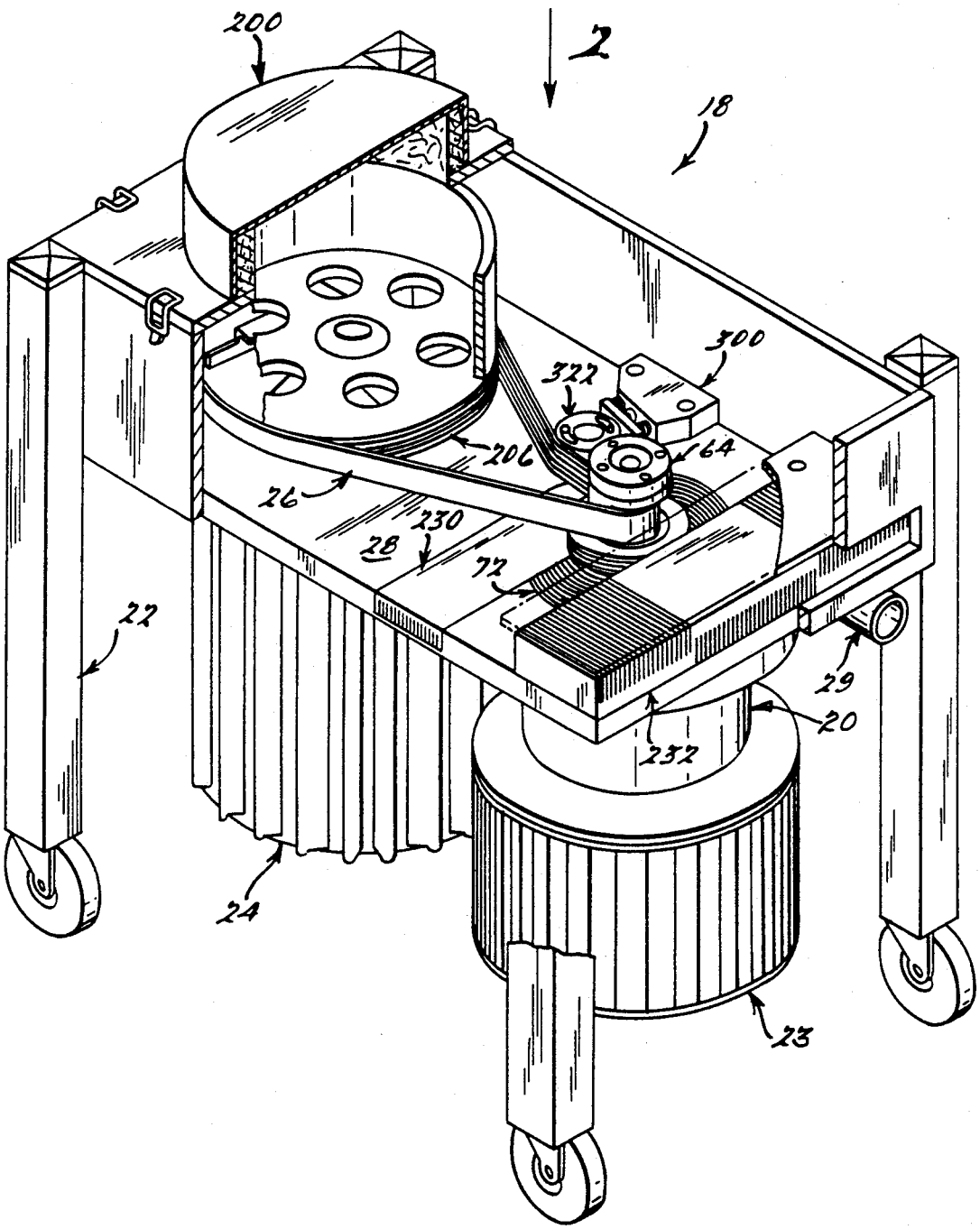
FIG. 1 is a perspective view, partially broken away for clarity, of an air compressor in accordance with an exemplary constructed embodiment of the present invention.

As seen in FIG. 1 of the drawings, an air compression system 18, in accordance with a preferred constructed embodiment of the instant invention, comprises an air compressor 20 mounted on a carriage 22 to facilitate transport of the assembly 18 about a work space. Ambient air is inducted through an air filter 23 to the air compressor 20.

The air compressor 20 is driven by an electric motor 24 through a belt 26 that is housed in a pressurized plenum 28, as will be described. Compressed air is discharged from an outlet 29.

Figure 4:
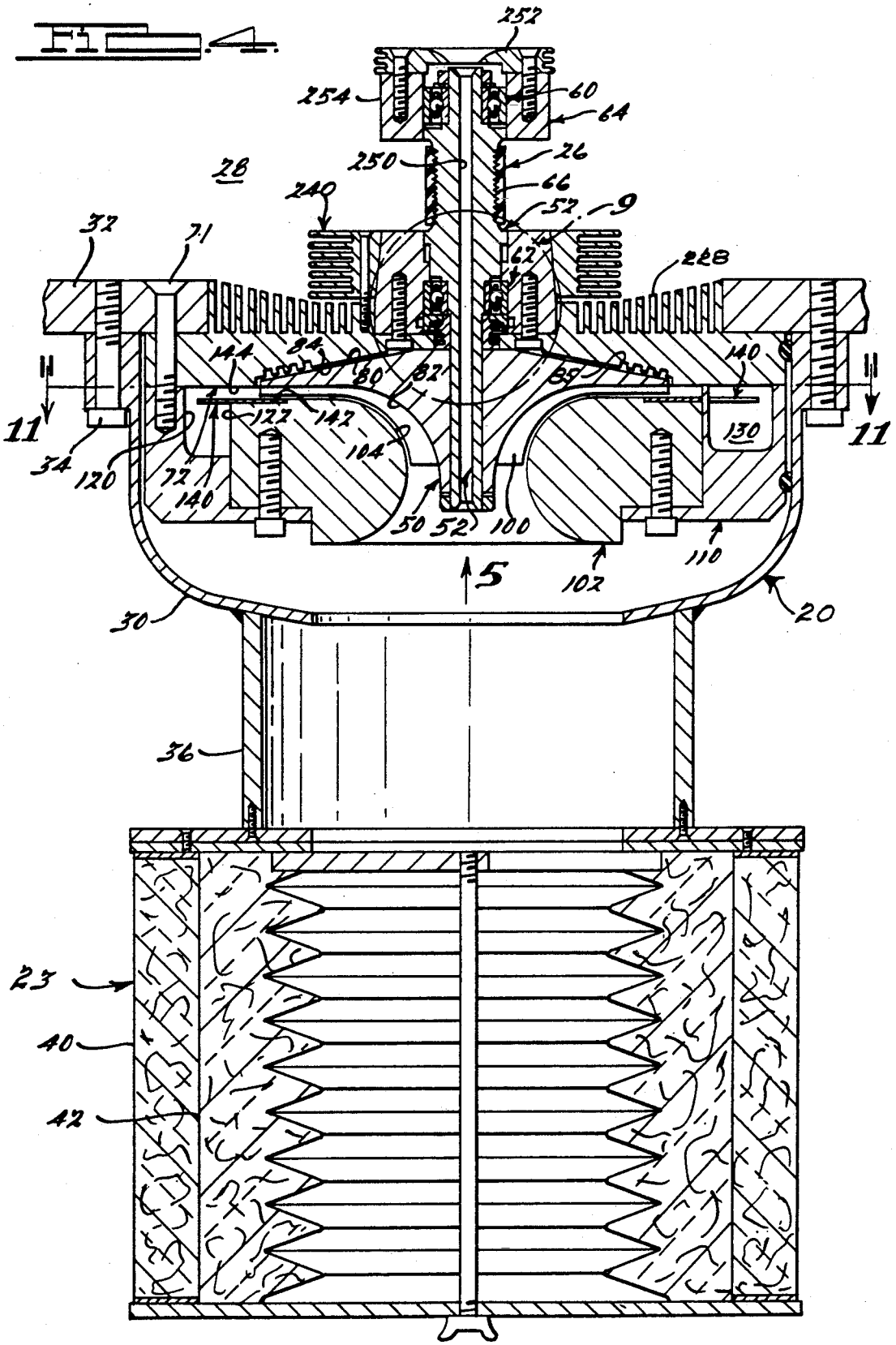
FIG. 4 is a view taken along the line 4—4 of FIG. 2.
Figure 13:
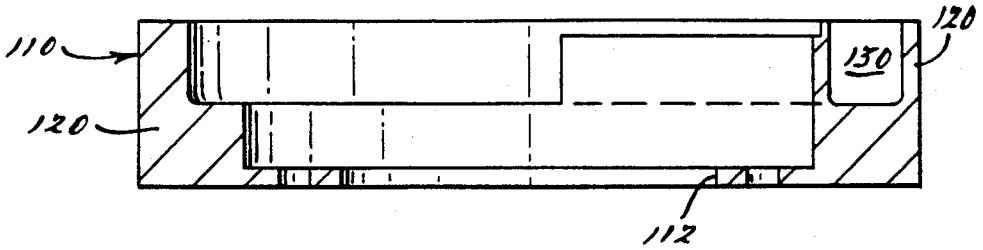
FIG. 13 is a view taken along the line 13—13 of FIG. 11.
Figure 11:
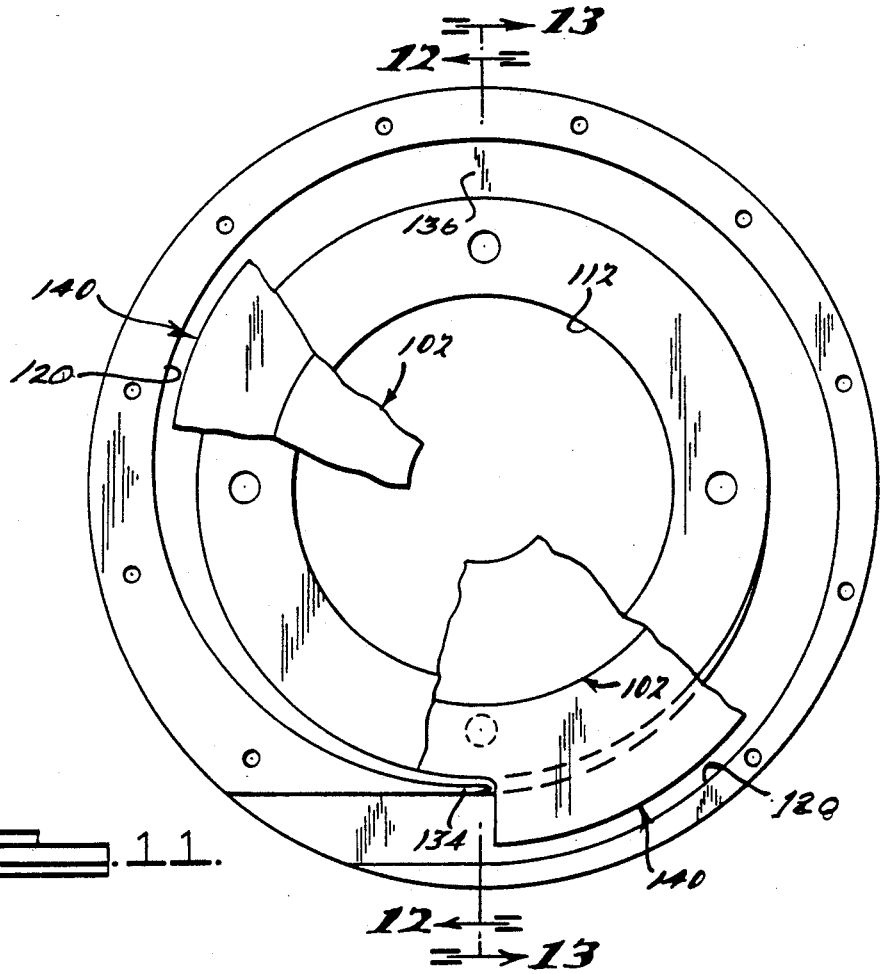
FIG. 11 is a view taken generally along the lines 11—11 of FIG. 4.

As best seen in FIG. 4 of the drawing, the air compressor 20 comprises an air inlet dome 30 that is secured to a platen or lower wall 32 of the plenum 28 by a plurality of bolts 34. A cylindrical lower extension 36 of the air inlet dome 30 supports the air filter 23 which comprises a radially outer primary filter element 40 and a high frequency sound absorbing baffle 42 disposed internally thereof.

The air compressor 20 comprises an impeller 50 that is mounted on and driven by an impeller shaft 52. The impeller shaft 52 is journaled in an upper bearing 60 and a lower bearing 62, both of which are supported by a bearing carrier 64. The bearing carrier 64 is of U-shaped configuration to provide for installation of the belt 26 and for running clearance thereof. The belt 26 is of the multiple V-groove type that is engaged in complementary V-grooves 66 in the impeller shaft 52.

The bearing carrier 64 is mounted on a combination compressor base and heat exchanger 72. The compressor base 72 is secured to the platen or bottom plate 32 of the plenum 28 as by a plurality of screws 71.

As best seen in FIG. 10, loss of air pressure of approximately 10 p.s.i. developed by the rotating impeller 50 is attenuated by a novel labyrinth seal 73 comprising a rotating element **73*a* and a fixed element 73*b* to minimize pressure leakage to the bearing 62 and plenum 28. The labyrinth seal element 73*a* is made from steel and has an upper flange 74 with a sharp radially outer edge. Air flows to the edge of the flange 74, thence out radially extending holes 75 in the seal element 73*b* into an annular groove 76 in the bearing housing 64. Leakage air then flows through a plurality of holes 77 and 78 which extend radially and axially, respectively, in the bearing housing 64 and communicate with the plenum 28**.

In accordance with another feature of the instant invention, as seen in FIGS. 4 and 5, the impeller 50 has a frusto-conical upper face 80 and a concave frusto conical configuration on a lower face 82. The upper impeller face 80 is accommodated within a complementary conical recess 84 in the base 72. The recess 84 has a labryinth seal 85 therein to attenuate pressure loss to the seal 73 described above.

The concave lower face 82 of the impeller 50 has a plurality of axially, radially and circumferentially extending blades 100 with concave outer edges, respectively, that are disposed in a circumferentially spaced array. The blades rotate in closely spaced relation to a complementary impeller housing 102, a convex outer surface 104 of which is of radial cross-sectional configuration complementary to that of the blades 100.

As best seen in FIG. 5, some of the impeller blades 100 have a circumferentially leading air intake scoop 106. All of the blades 100 have a tip section 107 that circumferentially trails the radially inner portion of the blade 100 by an angle of 35° relative to a radius drawn through the center of rotation of the impeller 50 and the tip thereof.

As seen in FIG. 6, the leading face 108 of each impeller blade 100 intersects the concave face 80 of the impeller 50 at a sharp right angle to maximize air flow efficiency whereas the trailing face 109 of each blade 100 intersects the impeller face 80 with an arcuate fillet at the root thereof to maximize strength.

Figure 12:
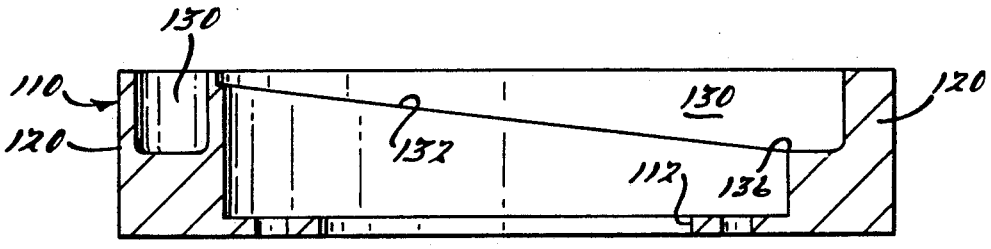
FIG. 12 is a view taken generally along the line 12—12 of FIG. 11.
Figure 15:
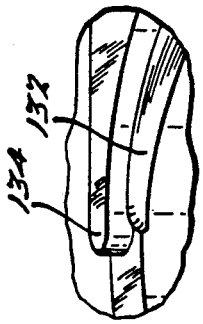
FIG. 15 is a view taken in the direction of the arrow 15 of FIG. 14.
Figure 14:
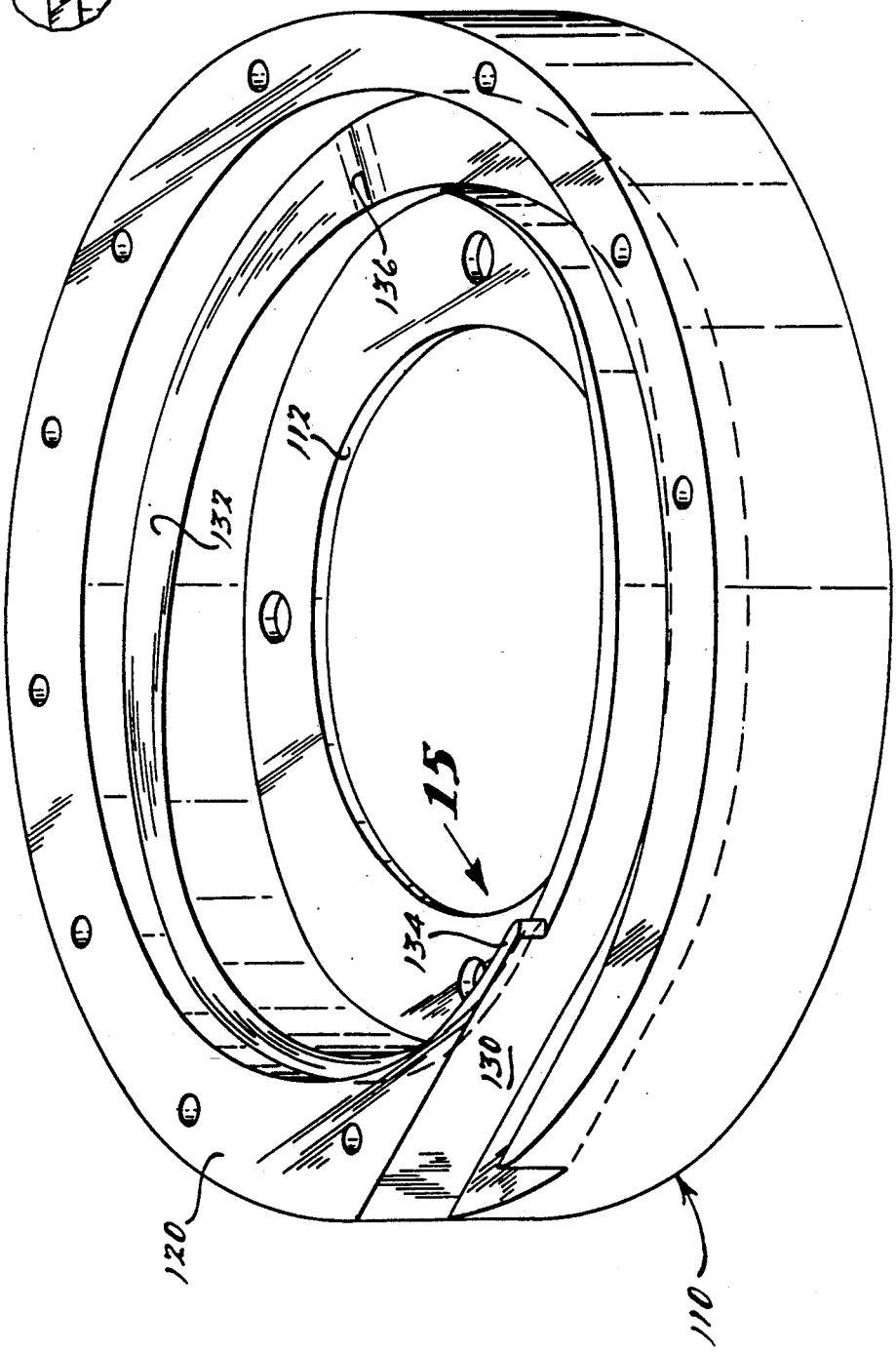
FIG. 14 is a perspective view of the diffuser housing of FIG. 11.

As best seen in FIGS. 11-14 of the drawings, the impeller housing 102 is supported by a novel scroll 110 which in turn is secured to the compressor base or platen 72 by the screws 74. The scroll 110 has a central aperture 112 for the acceptance of the impeller housing 102. The scroll 110 has an outer wall portion 120 disposed in radially spaced relation to an outer wall 122 of the impeller housing 102 to define the axially extending walls of an annular scroll shaped exit channel 130. The exit channel 130 is further defined by a ramp 132 that extends downwardly from an air flow splitter 134 to a low point 136 spaced 180° therefrom (FIG. 12).

In accordance with a feature of the invention, the air exit channel 130 is partitioned by a diffuser plate 140 that is disposed in a complementary recess 142 in the impeller housing 102. The diffuser plate 140 extends radially into spaced relation with the wall portion 120 of the diffuser 110 and functions as an air flow control plate that divides the diffuser 110 into a pair of axially spaced but communicating air passages and encourages laminar flow of air radially outwardly from the blades 100 of the impeller 50 into the air exit channel 130 between parallel walls defined by the diffuser plate 140 and a lower face 144 of the compressor base 72.

Figure 2:
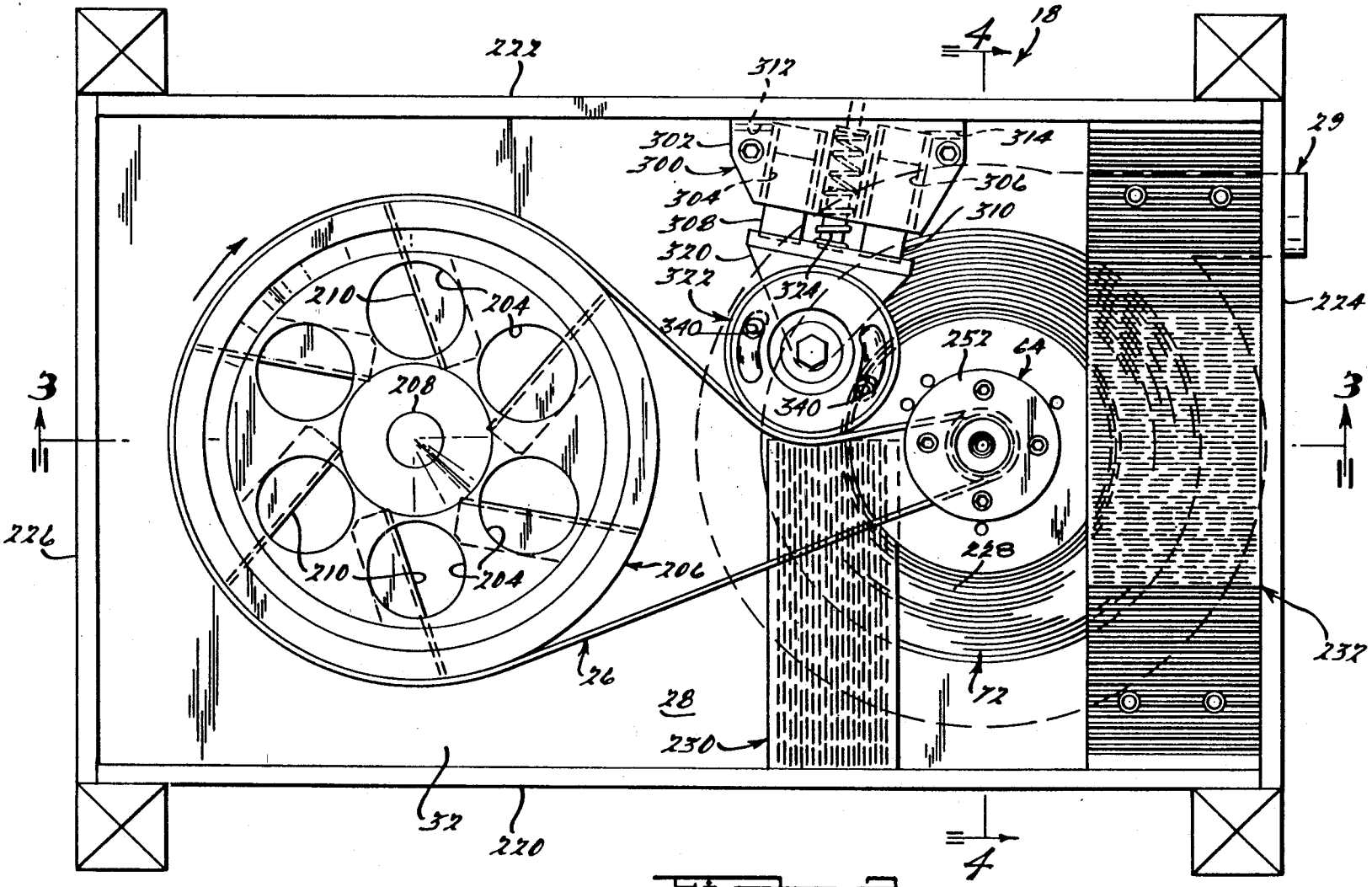
FIG. 2 is a view taken in the direction of the arrow 2 of FIG. 1.
Figure 3:
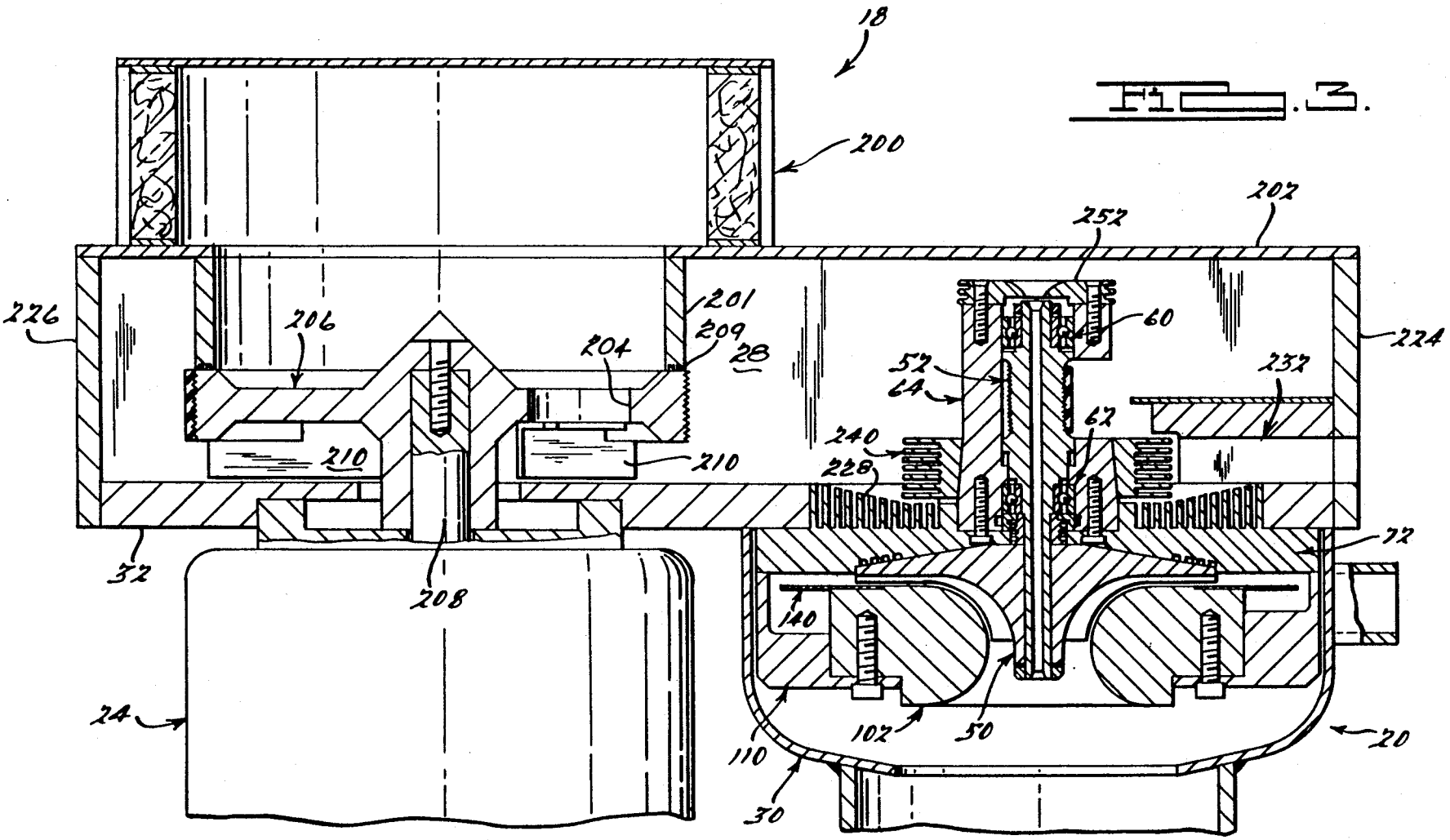
FIG. 3 is a cross-sectional view taken along the line 3—3 of FIG. 2.

The air compression system 18 of the present invention features a unique cooling system comprising a pressurized plenum and an integrated cooling air flow pattern through the plenum that materially extends the operating life of all of the components of the system 18. More specifically, as seen in FIGS. 1, 2 and 3, cooling air enters the system 18 through a filter 200 and shroud 201, both of which are mounted on an upper plate 202 of the plenum 28. A labyrinth seal 209 between the shroud 201 and pulley 206 maintains a pressure differential of approximately 1 p.s.i. between ambient pressure and the plenum 28. Air passes through the filter 200 thence downwardly through the shroud 201 to a plurality of apertures 204 in a belt drive pulley 206 mounted on a shaft 208 of the drive motor 24. Cooling air is drawn through the apertures 204 by a plurality of fan blades 210. The cooling air pressurizes the plenum 28 defined by the platen or base plate 32, side walls 220, 222; 224 and 226, and the top wall 202.

As best seen in FIGS. 2 and 3, pressurized air flows circumferentially of the compressor base 72 along and between fins 228 thence outwardly through a pair of heat exchanger elements 230 and 232 extending through the side walls 220 and 224, respectively. It is also to be noted that a finned sleeve 240 (FIG. 3), surrounds the bearing support 64 to conduct heat away therefrom which is transmitted to air flowing to the concentric fins 228 of the compressor base 72 and heat exchanger elements 230 and 232. Flow through the aforesaid heat exchange elements is achieved by the positive pressure in the plenum 28 relative to ambient pressure externally of the plenum 28.

As best seen in FIG. 4, a separate cooling air flow path is defined by a passage 250 extending centrally of the impeller drive shaft 52. A cap 252 on an upper leg 254 of the bearing support 64 provides for smooth laminar flow of air from the plenum 28 into the passage 250 in the drive shaft 52. Air moving downwardly, through the drive shaft 52 exits in the air stream flowing upwardly through the impeller housing 102 for compression by the impeller 50. Since the impeller housing 102 defines a venturi at the exit point of air flowing through the passage 250 of the impeller shaft 52, the relatively low pressure at the neck of the venturi tends to enhance the pressure differential induced flow from the pressurized plenum 28 to the inlet of the impeller housing 102.

As best seen in FIG. 2 of the drawings, the air compression system 18 of the present invention features a novel belt tensioner 300 which comprises a base 302 mounted on the wall 222 of the plenum 28. Base 302 has a pair of cylindrical bores 304 and 306 for the acceptance of a pair of pistons 308 and 310. The cylinders 304 and 306 and are vented by orifices 312 and 314, respectively, whereby air within the cylinders behind the pistons 308 and 310 functions as a damper to movement of the pistons 308 and 310. The pistons 308 and 310 are carried by a carrier 320, which has a pulley 322 mounted thereon for engagement with the belt 26 extending between the pulley 206 on the motor 24 and the impeller drive shaft 52. The carrier 320 and pulley 322 are normally biased into engagement with the belt 26 by a helical compression spring 324. Damping of the movement of the pistons 308 and 310 affects attenuation of resonance in the spring 324 due to oscillatory movement of the belt 26.

In accordance with yet another feature of the invention, cooling air in the plenum 28 is pressurized to a second stage by an integral fan aperture 340 in the pulley 322. Air flowing axially through the pulley 322 is discharged into the cooling fin 228 and thereafter flows circumferentially thence tangentially outwardly through the heat exchangers 230 and 232.

In operation, air is drawn upwardly through the filter 23 of the compressor 20 to the impeller housing 102. Air is accelerated by the impeller 50 and moves radially outwardly therefrom through the parallel walls defined by the lower wall 144 of the base plate 72 and the diffuser plate 140. The flow of air, which exhibits relatively high kinetic energy from the impeller 50, is thereafter directed downwardly, as seen in FIG. 4 of the drawings, into the annular scroll shaped exit channel 130 moving circumferentially therethrough as pressure energy to exit through the discharge nozzle 29.

Simultaneously, cooling air is drawn through the filter 200 into the plenum 28 by the pulley 206 and flows outwardly of the plenum 28 through the heat exchange element 228 in the compressor base 72 and heat exchange elements 230 and 232 thence to ambient.

From the aforesaid description it should be apparent that the present invention constitutes an integrated air compression system wherein the compression of air is achieved concomitantly with and cooling of the air compressor and related components in a novel manner. The elements of the system 18 exhibit a synergistic relationship to maximize efficiency and life expectancy of the air compression system 18.

While the preferred embodiment of the invention has been disclosed, it should be appreciated that the invention is susceptible of modification without departing from the scope of the following claims.

I claim:

1. A single stage centrifugal air compressor comprising a pressurized plenum, a frusto conical impeller disposed externally of said plenum and having a concave external face with a plurality of axially and radially extending blades disposed in a circumferentially spaced array thereon, an impeller housing having a convex surface complementary to the concave surface of the blades on said impeller, a diffuser housing spaced radially outwardly of said impeller having a pair of axially spaced walls lying in radially extending parallel planes defining an impeller discharge passage of substantial radial dimension communicating with and radially aligned with the periphery of said impeller, said diffuser housing having an annular outlet scroll disposed in axially spaced relation to the parallel walls of said impeller discharge passage and in fluid communication therewith whereby kinetic energy in air flowing radially from said impeller discharge passage is transformed to pressure energy in air flowing circumferentially of said impeller in said outlet scroll.

2. An air compressor in accordance with claim 1 wherein the blades of said impeller have a circumferentially trailing end portion.

3. An air compressor in accordance with claim 1 wherein one of said radially extending parallel walls comprises a plate extending into and partially dividing said annular compressor discharge passage into two axially spaced passages.

4. An air compressor in accordance with claim 1 wherein said impeller is cantilevered at one end of an impeller drive shaft that is supported by spaced bearings, said drive shaft having an integral pulley disposed internally of said plenum and intermediate said bearings.

5. An air compressor in accordance with claim 4 wherein said drive shaft has a passage extending longitudinally thereof with an inlet within said plenum and an outlet external to said plenum proximate a point of induction of air to said impeller.

6. An air compressor in accordance with claim 5 including means for establishing a flow of air through said passage in the opposite direction to the direction of air flow to said impeller.

7. An air compressor in accordance with claim 1 wherein the compressor discharge passage of said diffuser increases in radial cross section toward a discharge end thereof.

8. An air compression system comprising a plenum, a first air intake to said plenum, an electric motor supported externally of said plenum having a motor pulley disposed internally of said plenum, a first air impeller on said motor pulley for drawing ambient air through said first air intake into said plenum for pressurizing said plenum, an air compressor disposed exteriorly of said plenum having a second air impeller rotatable about an axis extending parallel to the axis of rotation of said electric motor, an impeller shaft for said second impeller having a pulley thereon disposed internally of said plenum; and a belt extending internally of said plenum between said motor pulley and said impeller pulley.

9. An air compression system in accordance with claim 8 wherein said second air impeller is surrounded by a plurality of heat exchange elements over which air flows from said first air intake under positive pressure to ambient.

10. An air compression system in accordance with claim 9 wherein said impeller shaft has a longitudinal passage therein in fluid flow communication with the interior of said plenum and an air intake to said impeller.

11. An air compression system in accordance with claim 9 including a belt tensioner having an integral pulley and fan in fluid flow relation between said plenum and said heat exchangers.

* * * * *